US010589759B2

(12) United States Patent
Coseglia

(10) Patent No.: US 10,589,759 B2
(45) Date of Patent: Mar. 17, 2020

(54) RAILWAY CAR TRUCK FRICTION SHOE

(71) Applicant: Amsted Rail Company, Inc., Chicago, IL (US)

(72) Inventor: John Coseglia, Edwardsville, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 126 days.

(21) Appl. No.: 15/453,515

(22) Filed: Mar. 8, 2017

(65) Prior Publication Data

US 2018/0257676 A1 Sep. 13, 2018

(51) Int. Cl.
*B61F 5/12* (2006.01)
*B61F 3/02* (2006.01)
*B61F 5/06* (2006.01)

(52) U.S. Cl.
CPC ..... *B61F 5/122* (2013.01); *B61F 3/02* (2013.01); *B61F 5/06* (2013.01)

(58) Field of Classification Search
CPC ..... B61F 3/00; B61F 3/02; B61F 5/00; B61F 5/04; B61F 5/06; B61F 5/12; B61F 5/122; B61F 5/24
See application file for complete search history.

(56) References Cited

U.S. PATENT DOCUMENTS

| | | | | |
|---|---|---|---|---|
| 4,109,585 | A * | 8/1978 | Brose | B61F 5/122 105/198.4 |
| 4,256,041 | A | 3/1981 | Kemper et al. | |
| 4,274,340 | A | 6/1981 | Neumann et al. | |
| 4,825,775 | A | 5/1989 | Stein | |
| 4,915,031 | A | 4/1990 | Wiebe | |
| 4,953,471 | A | 9/1990 | Wronkiewicz | |
| 7,174,837 | B2 * | 2/2007 | Berg | B61F 5/122 105/197.05 |
| 7,527,131 | B1 | 5/2009 | Wike | |
| 2002/0073880 | A1 * | 6/2002 | Wronkiewicz | B61F 5/122 105/182.1 |

FOREIGN PATENT DOCUMENTS

| | | |
|---|---|---|
| CN | 1576129 | 2/2005 |
| CN | 201095369 | 8/2008 |
| CN | 204586903 | 8/2015 |
| CN | 205044757 | 2/2016 |
| RU | 29276 | 10/2003 |
| RU | 124234 | 1/2013 |
| RU | 2523513 | 7/2014 |
| RU | 152898 | 6/2015 |

* cited by examiner

*Primary Examiner* — Robert J McCarry, Jr.
(74) *Attorney, Agent, or Firm* — Joseph M. Butscher; The Small Patent Law Group, LLC

(57) ABSTRACT

A friction shoe includes a bottom base engaging and supported by a pair of support springs, and a sloped wall engaging the sloped support face of a bolster. The bottom base includes a cylindrical spring lug that has a center opening that extends through the spring lug. The bottom surface of the spring lug is flat and smooth and is configured to engage an additional concentrically nested support spring. The additional spring increases the force between the vertical support face of the wedge and the vertical wear plate of the side frame.

20 Claims, 4 Drawing Sheets

RAILWAY CAR TRUCK FRICTION SHOE

BACKGROUND AND SUMMARY OF THE INVENTION

The invention relates generally to railway car truck friction damping arrangements, and more particularly to a railway car truck friction shoe.

The present invention is directed to a friction wedge or shoe for a railroad car truck and in particular to a friction shoe including a body having a sloped face and a vertical face. The friction shoe dissipates energy throughout the range of suspension travel and friction shoe and bolster velocities moving vertically along the side frame column wear plate.

Railroad car trucks of a design known as a three piece railway car truck include a pair of spaced apart side frames and a bolster that extends transversely between the side frames. The bolster is resiliently supported at each end on a respective side frame by a plurality of suspension springs. Wedge shaped friction shoes are used in such railroad car trucks to dampen movement of the bolster with respect to the side frame of the railroad car truck. Friction shoes are usually generally triangular wedge shaped such that two laterally spaced sloped faces are each in contact with laterally spaced sloped faces of the bolster. The friction shoe is also comprised of a vertical face that is in contact with a corresponding wear plate mounted on a vertical face of a side frame column. Accordingly, the friction shoe acts as a motion damping wedge between the bolster and the wear plate on a vertical column of the side frame.

The friction shoe also is comprised of a bottom section that joins the vertical face and the two laterally sloped faces.

The wear plate on the vertical column of the side frame is usually comprised of steel. The friction shoe is typically wedged into engagement between the sloped faces of the bolster and the vertical column of the side frame by a pair of concentrically arranged suspension springs. The bottom section of the friction shoe includes a protrusion which serves to constrain and locate the suspension springs. Resistance to sliding movement of the friction shoe with respect to the side frame, which in turn provides dampening of vertical bolster movement, is provided by the frictional forces generated between the friction shoe vertical face and a wear plate on the side frame vertical column.

It is an object of the present invention to provide an improved railway car truck friction shoe that allows the use of an additional concentrically nested spring to increase the damping frictional force on the vertical movement of the bolster for better control with greater energy dissipation. The bottom section includes a spring lug in the form of a hollow protrusion extending from the bottom section. This spring lug not only constrains and locates an outer and middle pair of suspension springs, but also the bottom surface of the lug is flat and smooth and is designed to engage a third concentrically arranged inner suspension spring. Additionally, the spring lug is hollow and as a result facilitates manufacturing of the friction shoe as the central hole helps locate the sand core that forms the hollow interior of the friction shoe. Further, the bottom center of the spring lug is open which allows water or other debris to pass through the friction shoe instead of collecting inside it.

BRIEF DESCRIPTION OF THE DRAWING FIGURES

DETAILED DESCRIPTION OF THE PREFERRED EMBODIMENT

Figure 1:
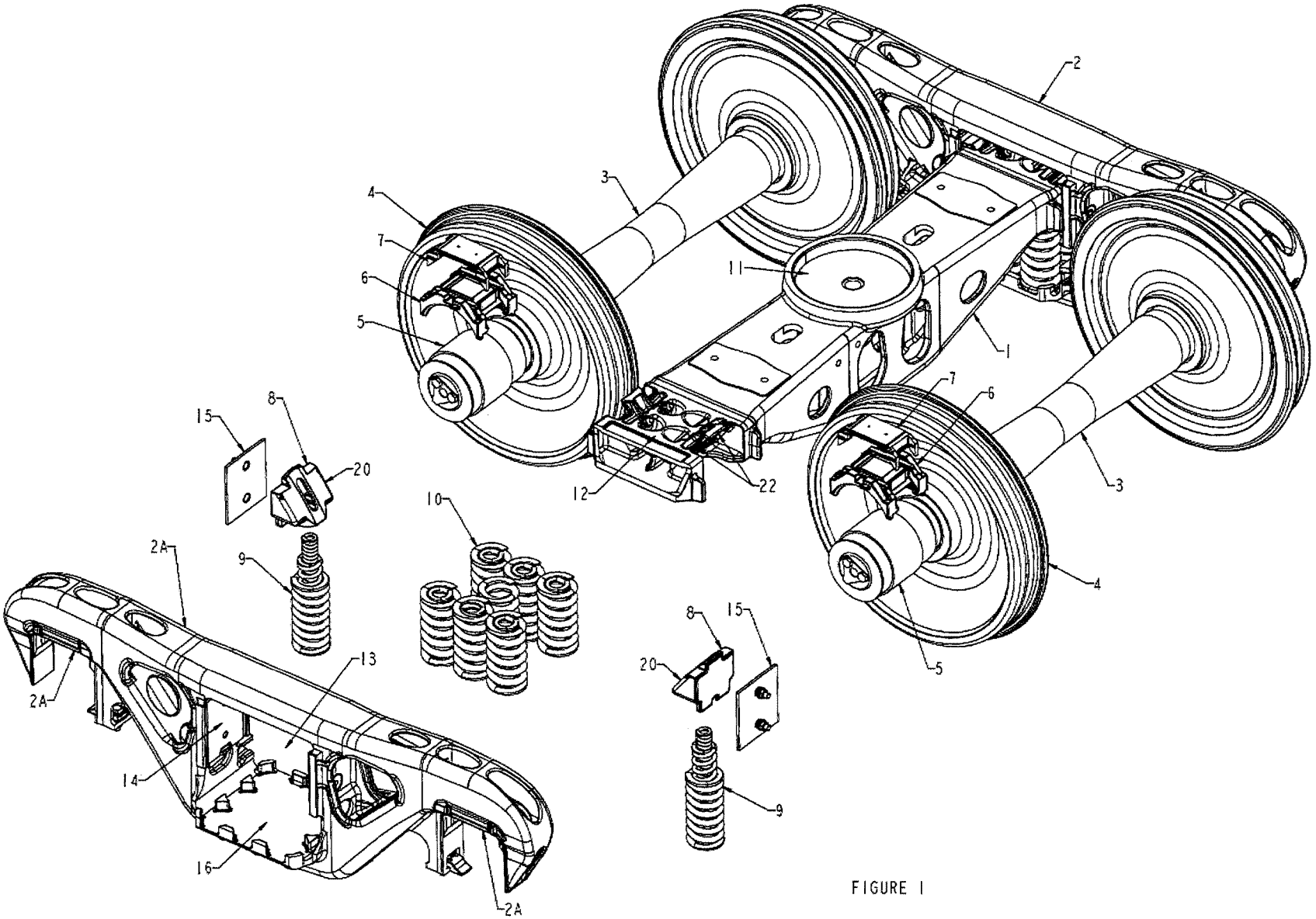
FIG. 1 is an exploded isometric view of a railway car truck in accordance with an embodiment of the present invention.

Referring now to FIG. 1, a friction wedge or shoe 8 of the present invention is shown in a railroad car truck. The railway car truck includes two side frames 2 which are spaced apart and generally parallel to one another. Each side frame 2 includes a bolster opening 13 formed by a pair of spaced apart vertical columns 14. A planar wear plate 15 is connected to the interior surface of each column 14. The railway car truck also includes a bolster 1 which extends generally transversely between the side frames 2. Each end 12 of the bolster 1 is located within a respective bolster opening 13 and is vertically supported on a side frame 2 by a plurality of helical coil suspension springs 10. The bolster end 12 is also supported by the friction shoes 8 which themselves are supported by suspension control springs 9. The suspension control springs 9 and suspension springs 10 are themselves supported on a spring support section 16 of each side frame 2. Suspension control springs 9 and suspension springs 10 are resiliently compressible to thereby allow the ends of the bolster 1 to move vertically upwardly and downwardly within the bolster openings 13 and with respect to the side frames 2. Each bolster end 12 includes a plurality of sloped walls 22. Each sloped wall 22 is adapted to engage a sloped surface 20 of a respective friction shoe 8. Friction shoe 8 is seen to provide a damping force to the vertical motion of bolster 1 while supported on suspension control springs 9 and suspension springs 10 as the railway car travels on the rails.

Railway wheels 4 are mounted on axles 3. Axle bearings 5 are mounted on the ends of axles 3. Bearings adaptor 6 and pad 7 are provided to receive axle bearings in side frame pedestal openings 13. Center bowl 11 on the top surface of bolster 1 is provided to help support the railway freight car on the truck.

Figure 2:
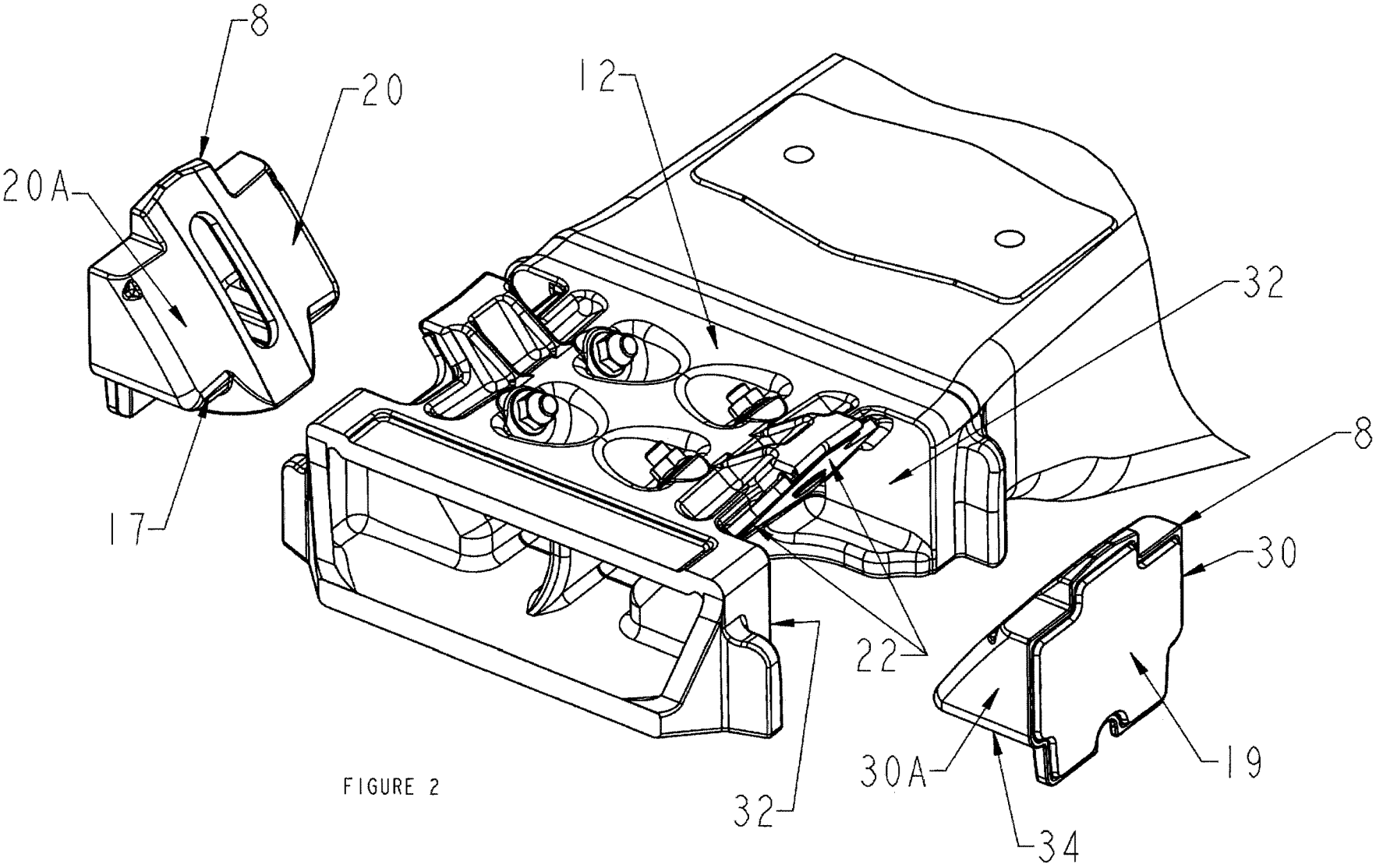
FIG. 2 is a detailed partial section view of a portion of a railway car truck in accordance with an embodiment of the present invention.

As best shown in FIG. 2, friction shoe 8 includes a body 17. Body 17 is generally triangular or wedge-shaped. The body 17 includes a base having a generally horizontal bottom wall 34. The bottom base surface 34 is adapted to engage the top end of a pair of concentrically nested suspension control springs 9 and includes a boss or spring lug 29 to control the location of the suspension control springs 9. Spring lug 29 is cylindrical in shape, the bottom surface 41 of spring lug 29 is flat and may have a center opening 39. The bottom surface 41 acts as a support surface for a third concentrically nested inner suspension control spring 42 and as such, the outside diameter is approximately the same size as the outside diameter of the inner suspension control spring and the inside diameter is approximately the same size as the inside diameter of the inner suspension control spring. Friction shoe body 17 is usually comprised of cast iron or cast steel.

Figure 4:
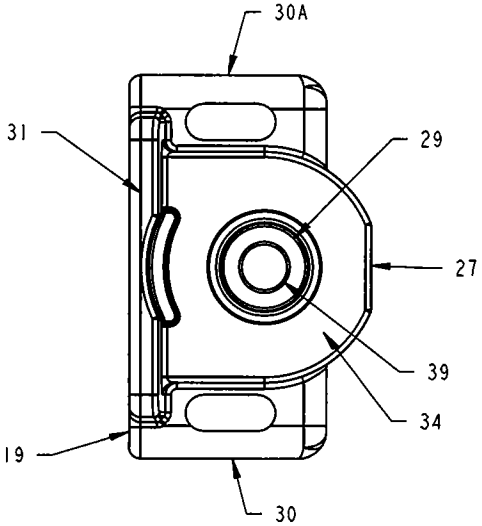
FIG. 4 is a bottom view of a friction shoe in accordance with an embodiment of the present invention.
Figure 3:
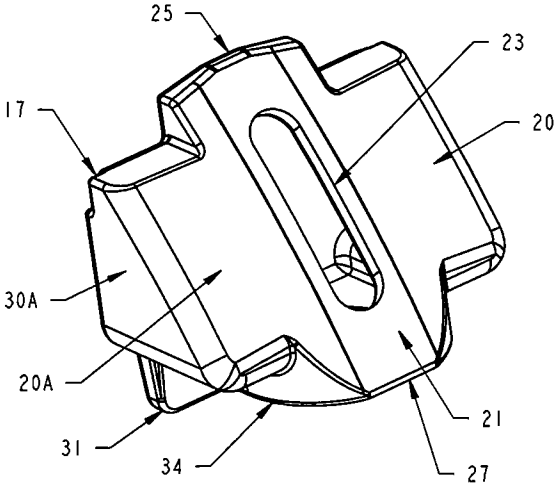
FIG. 3 is an isometric view of a friction shoe in accordance with an embodiment of the present invention.
Figure 5:
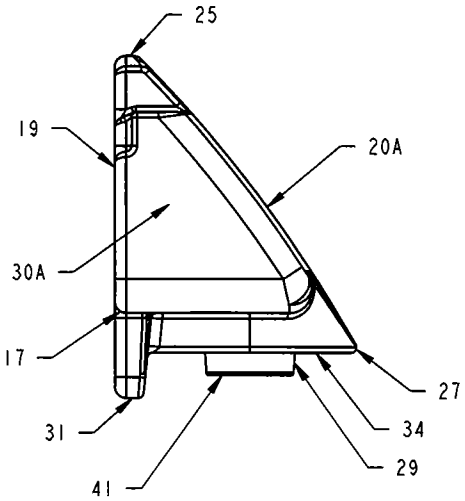
FIG. 5 is a side view of a friction shoe in accordance with an embodiment of the present invention.

As best shown in FIGS. 3, 4, and 5, friction shoe body 17 also includes a generally vertical front wall 19. The body 17 also includes laterally spaced sloped walls 20 and 20A that extend at an inclined angle of approximately thirty-five to forty-five degrees between the base 34 and front face 19. Sloped walls 20 and 20A are each adapted to engage an inclined walls 22 of the bolster 1. The front face 19 of friction shoe body 17 has an extension 31 that protrudes approximately one inch below the bottom base surface 34. Front face 19 of friction shoe body 17 is in direct contact with and extends from an intersection with top edge 25 of sloped surface 20 and 20A and center spacing section 21. Center spacing section 21 extends between laterally spaced sloped walls 20 and 20A. Center spacing section 21 may include an opening 23 that extends from near the top edge 25 of friction shoe body 17 to near intersection 27 between bottom base surface 34 and center spacing section 21. Center spacing section 21 may be recessed from sloped surfaces 20 and 20A.

The damping force developed by the friction shoe 8 is proportional to the force with which the front face 19 is impinged against side frame column wear plate 15 and can be increased by adding the third friction shoe supporting suspension control spring 42. The design of this friction shoe allows the inner suspension control spring 42 to be utilized and can add 200 to 1500 pounds force per inch of compression to the vertical force under the friction shoe.

What is claimed is:

1. A railway car truck comprising:

two parallel side frames, each side frame having at least one vertical support face:

a suspension spring assembly supported by the side frames;

a bolster transversely mounted between the side frames and supported by the suspension spring assembly, the bolster having at least one sloped support face;

an outer suspension spring;

a first inner suspension spring that is concentric with the outer suspension spring;

a second inner suspension spring that is concentric with the outer suspension spring and the first inner suspension spring, wherein the outer suspension spring, the first inner suspension spring, and the second inner suspension spring are concentrically nested; and a friction shoe comprising:

two laterally spaced sloped walls each engaging one sloped support face of the bolster;

a vertical wall engaging the vertical support face of the side frame;

a bottom base engaging and supported by the outer suspension spring, the first inner suspension spring, and the second inner suspension spring, the bottom base including a cylindrical spring lug extending downwardly therefrom, the cylindrical spring lug having a center opening leading into a hollow area of the friction shoe and having a smooth flat bottom surface which engages the second inner suspension spring.

2. The friction shoe of claim 1, wherein the friction shoe has two generally triangular side walls each having a manufacturing core support hole.

3. The friction shoe of claim 1, wherein an outside diameter of the cylindrical spring lug is approximately equal to an outside diameter of the second inner suspension spring, an inside diameter of the cylindrical spring lug is approximately equal to an inside diameter of the second inner suspension spring, an inside diameter of the first inner suspension spring is greater than the outside diameter of the second inner suspension spring, and an inside diameter of the outer suspension spring is greater than an outside diameter of the first inner suspension spring.

4. The friction shoe of claim 1, wherein the friction shoe provides a damping force of between 7500 and 12,000 pounds when the friction shoe is moving at a velocity of between 0 and 19 inches per second.

5. The friction shoe of claim 1, wherein the friction shoe is comprised of cast iron.

6. The friction shoe of claim 1, wherein the friction shoe is comprised of cast steel.

7. The friction shoe of claim 1, wherein the friction shoe has a composite facing applied to the vertical support surface.

8. The friction shoe of claim 1, wherein the laterally spaced sloped walls are comprised of two laterally spaced surfaces with a spacing wall located between the two laterally spaced surfaces.

9. A railway car truck, the railway car truck comprising:

an outer suspension spring;

a first inner suspension spring that is concentric with the outer suspension spring;

a second inner suspension spring that is concentric with the outer suspension spring and the first inner suspension spring, wherein the outer suspension spring, the first inner suspension spring, and the second inner suspension spring are concentrically nested; and a friction shoe comprising:

a bottom base engaging and supported by the outer suspension spring, the first inner suspension spring, and the second inner suspension spring, the bottom base including a cylindrical spring lug extending downwardly therefrom, the cylindrical spring lug having a bottom surface that engages the second inner suspension spring;

a sloped wall configured to engage a sloped support face of a bolster; and a vertical wall configured to engage a vertical support face of a side frame.

10. The railway car truck of claim 9, wherein the spring lug includes a hollow opening extending vertically through the spring lug, wherein an outside diameter of the cylindrical spring lug is approximately equal to an outside diameter of the second inner suspension spring, an inside diameter of the cylindrical spring lug is approximately equal to an inside diameter of the second inner suspension spring, an inside diameter of the first inner suspension spring is greater than the outside diameter of the second inner suspension spring, and an inside diameter of the outer suspension spring is greater than an outside diameter of the first inner suspension spring.

11. The railway car truck of claim 9, wherein the friction shoe provides a damping force of between 7500 and 16,250 pounds when the friction shoe is moving at a velocity of between 0 and 19 inches per second.

12. The railway car truck of claim 9, wherein the friction shoe provides a normal force of between 2000 and 12,000 pounds.

13. The railway car truck of claim 9, wherein the friction shoe is comprised of cast iron.

14. The railway car truck of claim 9, wherein the friction shoe is comprised of cast steel.

15. The railway car truck of claim 9, wherein the sloped wall extends to direct contact with the bottom base.

16. The railway car truck of claim 9, wherein the sloped wall is comprised of two laterally spaced surfaces with a spacing wall located between the two laterally spaced surfaces.

17. A railway car truck, comprising:

an outer suspension spring;

a first inner suspension spring that is concentric with the outer suspension spring;

a second inner suspension spring that is concentric with the outer suspension spring and the first inner suspension spring, wherein the outer suspension spring, the first inner suspension spring, and the second inner suspension spring are concentrically nested; and a friction shoe comprising:

a bottom base engaging the outer suspension spring, the first inner suspension spring, and the second inner suspension spring, the bottom base including a spring lug extending downwardly therefrom, the spring lug comprising:

a hollow opening extending vertically through the spring lug; and a flat bottom surface, wherein the flat bottom surface provides a support surface that engages the second inner suspension spring.

18. The railway car truck of claim 17, wherein the spring lug is cylindrical, wherein an outside diameter of the cylindrical spring lug is approximately equal to an outside diameter of the second inner suspension spring, an inside diameter of the cylindrical spring lug is approximately equal to an inside diameter of the second inner suspension spring, an inside diameter of the first inner suspension spring is greater than the outside diameter of the second inner suspension spring, and an inside diameter of the outer suspension spring is greater than an outside diameter of the first inner suspension spring.

19. The railway car truck of claim 18, further comprising a vertical wall configured to engage a vertical support face of a side frame.

20. The railway car truck of claim 17, further comprising a sloped wall configured to engage a sloped support face of a bolster, the sloped wall extending to direct contact with the bottom base.

* * * * *